US005899496A

United States Patent [19]

Muraro

[11] Patent Number: 5,899,496

[45] Date of Patent: May 4, 1999

[54] VARIABLE-GEOMETRY STABILIZING FOOT, IN PARTICULAR FOR EARTH-MOVING VEHICLES

[75] Inventor: Umberto Muraro, Noventa Vicentina, Italy

[73] Assignee: Fki Fai Komatsu Industries S.p.A., Noventa Vicentina, Italy

[21] Appl. No.: 08/805,237

[22] Filed: Feb. 24, 1997

[30] Foreign Application Priority Data

Mar. 13, 1996 [IT] Italy ..... VR96A0029

[51] Int. Cl.[6] ..... B60S 9/02

[52] U.S. Cl. ..... 280/765.1; 280/766.1

[58] Field of Search ..... 188/5, 6, 7; 280/763.1, 280/764.1, 765.1, 766.1, 43.22, 43.23; 212/305; 37/902, 907

[56] References Cited

U.S. PATENT DOCUMENTS

| | | | |
|---|---|---|---|
| 4,084,777 | 4/1978 | Lambert | 280/766.1 X |
| 4,437,682 | 3/1984 | Yokoyama et al. | 280/764.1 |
| 4,536,009 | 8/1985 | Ashworth | 280/764.1 X |
| 4,569,422 | 2/1986 | Hoffman | 280/764.1 X |
| 4,593,932 | 6/1986 | Miyazawa | 280/765.1 |

*Primary Examiner*—Richard M. Camby
*Assistant Examiner*—William R. Zimmerli
*Attorney, Agent, or Firm*—Browdy and Neimark

[57] ABSTRACT

A variable-geometry stabilizing foot, in particular for earth-moving vehicles, comprising a support member (1) able to rotate about a fulcrum (3) associated with the chassis of a vehicle to be stabilized and a extendable arm (5) slidably mounted on this support member (1). A control linkage (9) is also provided, being hinged with the chassis (2) of the vehicle and with the extendable arm (5) is provided at the bottom end with a support foot (8) able to perform vertical displacements when a hydraulic jack (13) moves the support member (1) between a recovery position (15) and an operative position (16). In the recovery position (15) the stabilizing foot is thus arranged so as to be retracted and take up little space on the chassis (2) of the vehicle, while in the operative position (16), the stabilizing foot is rotated through an angle ($\alpha$) towards the ground with respect to the recovery position (15). The chassis (2) of the vehicle also comprises a shaped member (14) designed to receive in abutment the support foot (8) and rotate it towards the chassis (2) when the support member (1) is brought into the recovery position (15).

6 Claims, 3 Drawing Sheets

VARIABLE-GEOMETRY STABILIZING FOOT, IN PARTICULAR FOR EARTH-MOVING VEHICLES

BACKGROUND OF THE INVENTION

1. Field of the Invention

The present invention relates to a variable-geometry stablizing foot which can be mounted in particular on earth-moving vehicles.

2. Prior Art

As is known, stabilizing feet are mounted on special vehicles subject to intense destabilizing thrusting forces, in order to provide support bases which are much more stable than those provided by wheels alone.

At present, in accordance with the known art, substantially two types of stabilizing feet are used. A first type of stabilizing foot is mounted vertically on the chassis of said vehicles, being generally arranged in pairs on the rear part of the vehicles themselves. This type of stabilizing foot, already known in the art, consists of a support sleeve, integral with the vehicle body, and an extendable arm slidably mounted inside the support sleeve and having a bottom end provided with a support foot for ensuring a grip on the ground. By means of a (hydraulic) actuating system, the extendable arm is moved so as to extend from the support sleeve towards the ground until it comes into contact therewith by means of its support foot. Generally this type of stabilizer is provided with a hydraulic jack having a support foot connected to the free end of the internal stem. In practice, this type of stabilizer has proved to have drawbacks.

A first drawback arises from the fact that the earth-moving vehicles have the excavator arm mounted on a carriage movable horizontally on the rear side of the vehicles themselves. In this way, the position of the stabilizing feet, designed in accordance with the known art described, constitutes an obstacle for the carriage movement (which is in fact restricted horizontally), preventing the possibility of optimum operation of the excavator arms.

Moreover, since this type of stabilizing foot is able to perform only a vertical movement, it does not allow the support base of the vehicles to be modified in accordance with the operating needs which may arise.

In order to overcome these drawbacks, a second type of stabilizing foot (extending in an inclined manner) has thus become widespread, said foot being connected to the vehicle chassis by means of a hinge able to allow orientation thereof in accordance with operational requirements. In a similar manner to the first type, this stabilizing foot consists of an external support sleeve and an extendable arm sliding inside it. The extendable arm has passing through it along its longitudinal extension a series of through-holes able to match a selector hole formed on the support sleeve. By means of a fixing pin, which can be movably inserted into the selector hole and fitting into one of the holes of the extendable arm, it is possible to fix the support sleeve and the extendable arm with respect to one another. Operationally speaking, it is therefore possible to remove the pin from the selector hole, displace the extendable arm inside the support sleeve and re-insert the pin into a new hole of the extendable arm. Once the length of the stabilizing foot has been chosen by means of insertion of the pin into the selected hole, it is possible to operate the stabilizing foot hydraulically, causing it to rotate on the hinge until the support foot comes into contact with the ground. The use of stabilizing feet of this type which can be varied lengthwise makes it possible to modify the support base of the vehicle. This second type of stabilizing foot, however, during use has also proved to have some disadvantages.

First of all, such stabilizing feet transmit a notable thrusting force in an oblique direction on the ground, causing the deformation thereof in the zone where the foot rests. Since, in most cases, the ground consists of the road surface, a costly operation involving reconstruction of the damaged parts of the road is often necessary.

Another disadvantage arises from the fact that, in order to be able to vary the support base formed by the stabilizing feet, it is necessary to displace the position of the extendable arm inside the support sleeve by means of a manual or hydraulic operation, the first being difficult and awkward and the second costly.

The drawback of this second type of stabilizing foot consisting in damage to the road surface does not arise for the stabilizing feet of the first type which, acting in an exclusively vertical direction, do not damage the road surface. On the other hand, since the stabilizing feet of the second type are mounted below the chassis of the vehicle at the rear thereof, they do not obstruct at all sliding of the carriage on which the excavator arm is mounted.

SUMMARY OF THE INVENTION

The essential object of the present invention is therefore that of eliminating the drawbacks of the art known hitherto by providing a stabilizing foot with which it is possible to modify the support base of the vehicle in accordance with operational requirements as well as ensure that the supporting foot has a grip on the ground without damaging the road surface.

Another object of the present invention is that of providing a stabilizing foot which can be connected to the chassis of the vehicle in a position such as not to obstruct any movement of the excavator arm.

A further object of the present invention is that of providing a stabilizing foot which is constructionally simple and operationally totally reliable.

SHORT DESCRIPTION OF THE DRAWINGS

The technical features of the invention, in accordance with the aforementioned objects, may be clearly determined from the contents of the claims indicated below and the advantages thereof will clearly emerge from the detailed description which follows, with reference to the accompanying drawings, showing a purely exemplary and non-limiting embodiment thereof, in which:

DETAILED DESCRIPTION OF PREFERRED EMBODIMENTS

Figure 1:
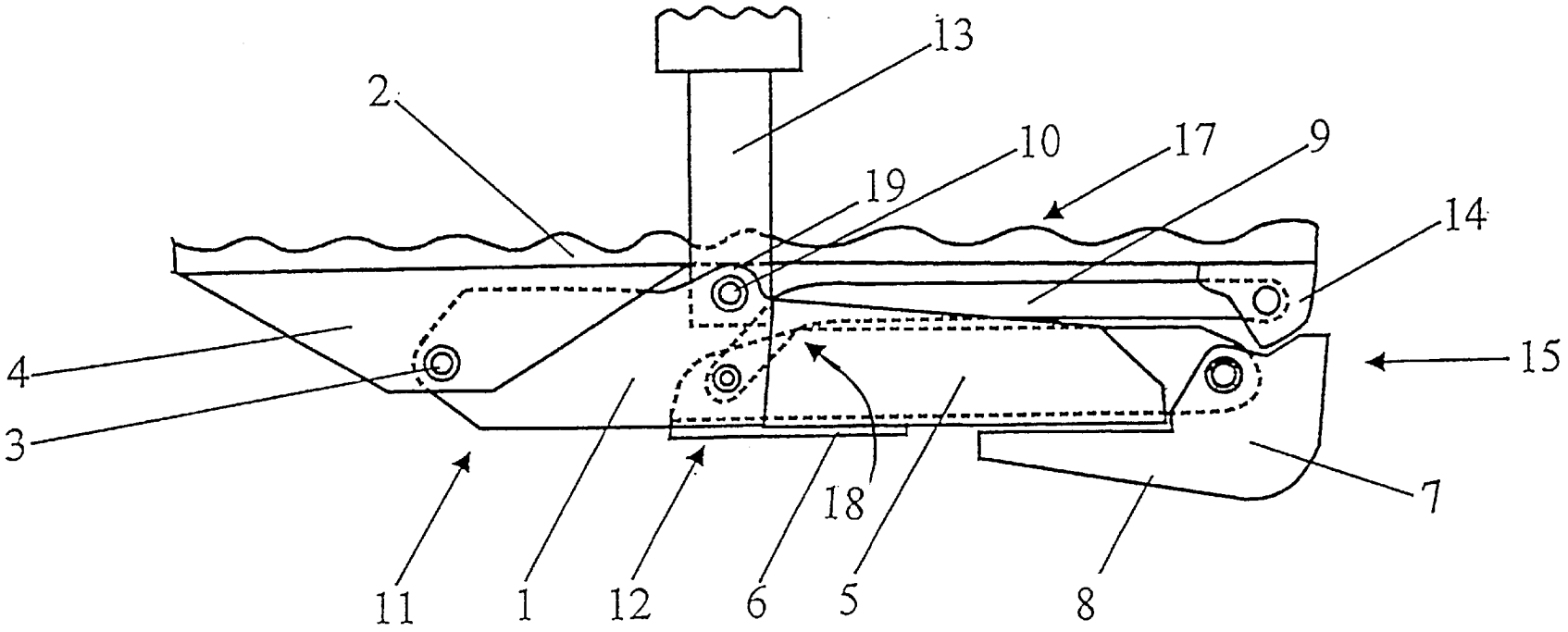
FIG. 1 shows in diagrammatic form the stabilizing foot forming the subject of the present invention, retracted on the chassis of a vehicle.
Figure 2:
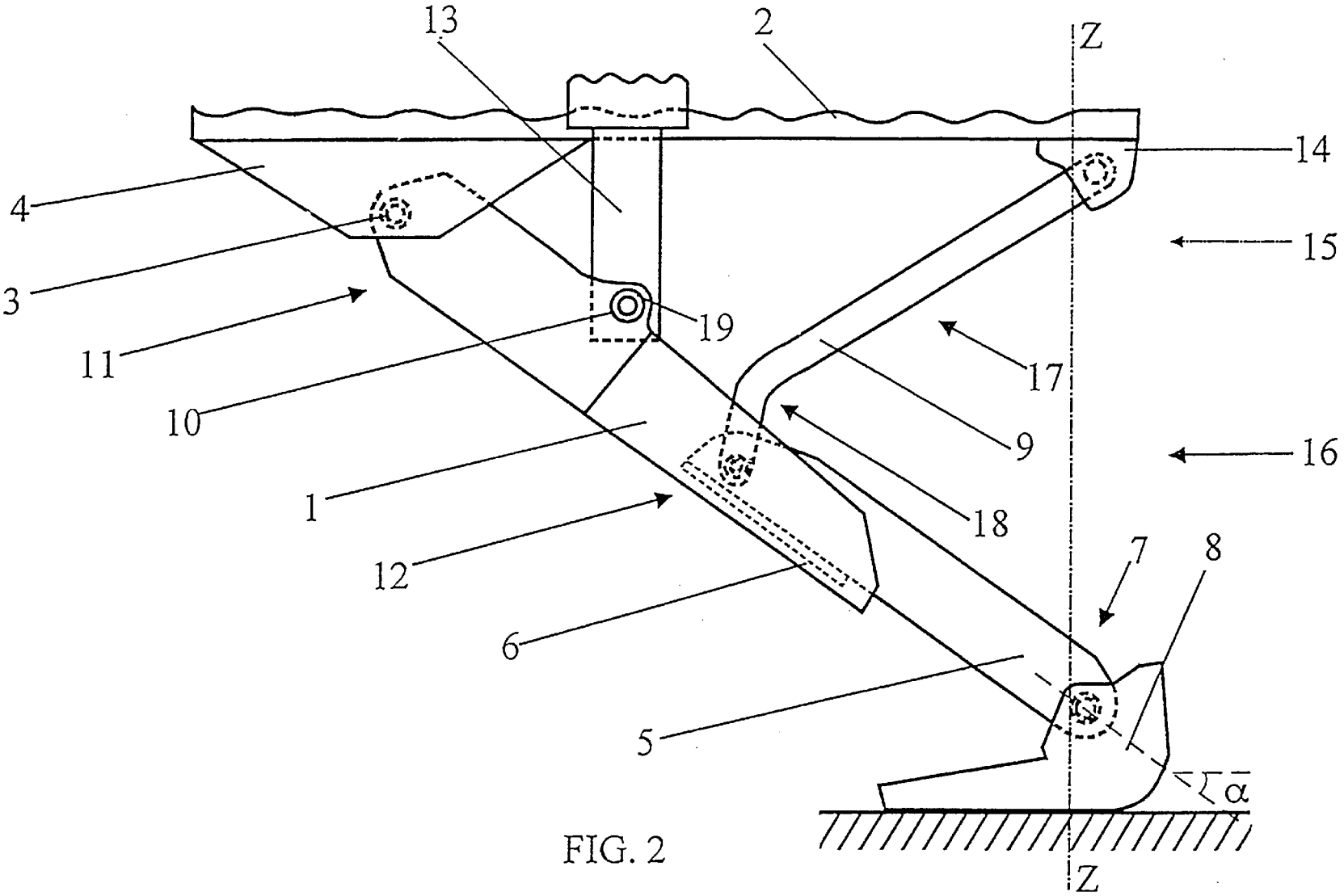
FIG. 2 shows in diagrammatic form the foot according to FIG. 1 in the operative position.
Figure 3:
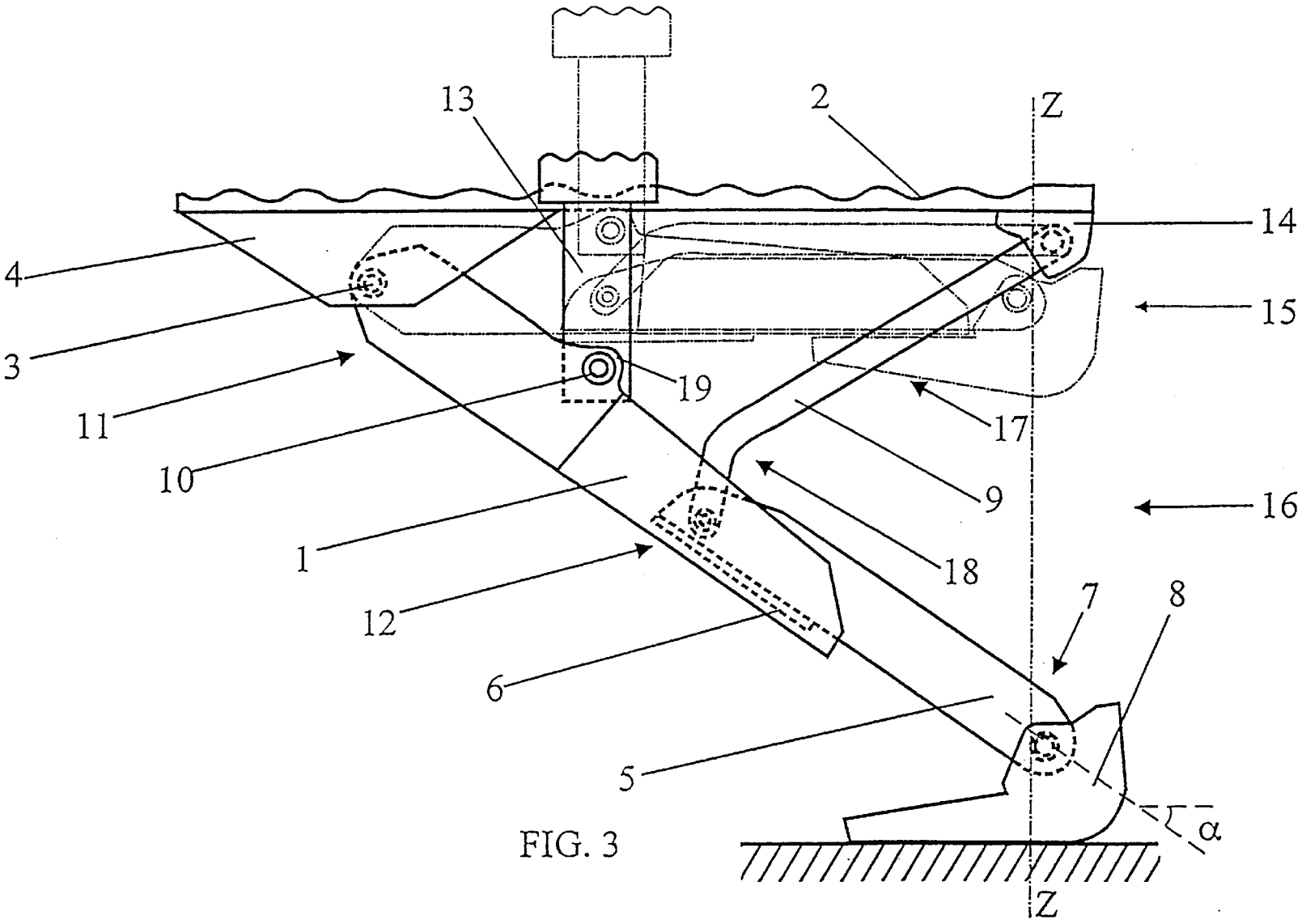
FIG. 3 shows in diagrammatic form the stabilizing foot both in the retracted position (broken lines) and in the operative position (continuous lines).

In accordance with the accompanying drawings, the stabilizing foot forming the subject of the present invention comprises a support casing 1 having a longitudinal extension with a top end 11 connected to the chassis 2 of a vehicle by means of a first hinge 3 about which the support casing 1 is free to rotate. For this purpose, the chassis 2 of the vehicle is provided with a structural member 4 on which there is arranged the first hinge 3 having a substantially horizontal axis of rotation.

The support casing 1 has mounted inside it an extendable arm 5 which is able to slide by means of a sliding shoe 6 along the longitudinal extension of the support casing 1. The extendable arm 5 has a bottom end 7 hinged with a support foot 8 able to ensure a grip on the ground. A control linkage 9 is also provided, being hinged on one end with the chassis 2 of the vehicle and, on the other end, with the top end 12 of the extendable arm 5.

Movement of the stabilizing foot is obtained by means of a hydraulic jack 13 hinged, on one hand, with the chassis 2 of the vehicle and, on the other hand, by means of a second hinge 10, with a lug 19 of the support casing 1. Operationally speaking, when the stabilizing foot is actuated, the following occurs:

The jack 13 moves the support casing 1 from the recovery position 15, where the stabilizing foot is retracted on the chassis 2 of the vehicle, to the operative position 16, where the stabilizing foot is rotated through an angle $\alpha$ with respect to the recovery position 15. In the recovery position 15, the stabilizing foot 15 is arranged horizontally on the chassis of the vehicle in a configuration occupying a minimum amount of space with the extendable arm 5 inserted inside the support casing 1. The jack 13, when actuated so as to perform stabilization of the vehicle, pushes the support casing 1 vertically downwards, causing rotation thereof about the hinge 3. Following this rotation, the control linkage 9, acting on the top end 12 of the extendable arm 5, causes sliding of the latter along the support casing 1. At the same time as sliding of the extendable arm 5, the support foot 8 is displaced in a substantially vertical direction Z until it comes into contact with the ground. In this way the thrust transmitted by the vehicle to the ground is transmitted via the support foot 8 only in a vertical direction, thus not exerting on the ground any sliding action which may involve damage to the road surface.

It should be noted that the jack 13 is hinged at both its ends so as to be able to perform the small rotations necessary for causing rotation of the support casing 1 to which it is fixed.

In order to limit the space occupied by the support foot 8, the chassis 2 of the vehicle is provided with a shaped member 14 designed to receive in abutment the support foot 8 and rotate it towards the chassis 2 when the support casing 1 is brought into the recovery position 15.

The control linkage 9 consists of a rigid bar having a substantially straight portion 17, connected to the chassis 2 of the vehicle, and a curved portion 18, connected to the extendable arm 5. When the stabilizing foot is arranged in the recovery position 15, the configuration of the rigid bar is such as to arrange the straight portion 17 horizontally in contact with the chassis 2 of the vehicle, thus resulting in an extremely small amount of space occupied.

What is claimed is:

1. Variable-geometry stabilizing foot for earth-moving vehicles, comprising: a support member (1) able to rotate about a fulcrum (3) associated with the chassis (2) of a vehicle to be stabilized; an extendable arm (5) slidably mounted on said support member (1) and provided with a support foot (8); a control linkage (9) hinged with the chassis (2) of said vehicle and with said extendable arm (5) providing slidable movement of the extendable arm (5) with said support member (1) and at the same time for causing a displacement in a substantially vertical direction (Z) of said support foot (8) when actuating means move said support member (1) between a recovery position (15) where said stabilizing foot is arranged so as to be retracted on the chassis (2) of said vehicle, and an operative position (16), where said stabilizing foot is rotated through an angle ($\alpha$) towards the ground with respect to the recovery position (15), thereby bringing said support foot (8) into contact with the ground.

2. Stabilizing foot as claimed in claim 1, wherein the chassis (2) of said vehicle comprises a shaped member (14) designed to receive in abutment said support foot (8) and rotate it towards said frame (2) when said support member (1) is brought into said recovery position (15) in order to reduce the space occupied by said shaped foot (8).

3. Stabilizing foot as claimed in claim 1, wherein the chassis (2) of said vehicle comprises a structural member (4) having formed on a first hinge (3) designed to connect one end of said support member to the chassis of the vehicle.

4. Stabilizing foot as claimed in claim 1, wherein said actuating means comprises a hydraulic jack (13) hinged with said support member by means of a second hinge (10).

5. Stabilizing foot as claimed in claim 1, wherein said support member (1) has a casing and said extendable arm (5) is positioned inside the casing.

6. Stabilizing foot as claimed in claim 1, wherein said control linkage (9) comprises a rigid bar having a substantially straight portion (17) connected to the chassis (2) of the vehicle and a curved portion (18) connected to the extendable arm (5).

* * * * *